US009459557B1

(12) United States Patent
Kasukawa

(10) Patent No.: US 9,459,557 B1
(45) Date of Patent: Oct. 4, 2016

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Masayuki Kasukawa, Saitama (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/808,070

(22) Filed: Jul. 24, 2015

(51) Int. Cl.
*G03G 15/08* (2006.01)

(52) U.S. Cl.
CPC ..... *G03G 15/0881* (2013.01)

(58) Field of Classification Search
CPC ..... G03G 15/0832; G03G 15/0881; G03G 15/0886; G03G 2215/0692
See application file for complete search history.

(56) References Cited

U.S. PATENT DOCUMENTS

2012/0230736 A1* 9/2012 Hosokawa ..... G03G 15/0886 399/262

FOREIGN PATENT DOCUMENTS

JP 2009116143 A * 5/2009

OTHER PUBLICATIONS

Kanda et al. (JP 2009-116143 A) May 2009, JPO Computer Translation.*

* cited by examiner

*Primary Examiner* — Erika J Villaluna
(74) *Attorney, Agent, or Firm* — Amin, Turocy & Watson LLP; Gregory Turocy

(57) ABSTRACT

An image forming apparatus comprises a first component, a second component, a first end surface, a second end surface and a sealer. The sealer arranged on the first or second end surface seals the part between the first end surface and the second end surface while keeping the first opening communicated with the second opening when the second component is mounted on the first component.

11 Claims, 5 Drawing Sheets

IMAGE FORMING APPARATUS

FIELD

Embodiments described herein relate to an image forming apparatus.

BACKGROUND

In some image forming apparatuses, a developer for charging a toner is dismountable with respect to a toner feeding section for the sake of the maintenance on the developer and the like. Sometimes, the direction from which the developer is mounted or dismounted with respect to the toner feeding section is limited by the parts arranged around the developer. The toner feeding section feeds a toner from the opening thereof to the opening of the developer.

In such an image forming apparatus, a sponge (sealer) is arranged between the edge of the opening of the toner feeding section and that of the opening of the developer so as to seal the part between the edge of the opening, of the toner feeding section and that of the opening of the developer. For example, the sponge is arranged on the edge of the opening of the developer. To be dismounted from the toner feeding section, the developer is sometimes moved towards a direction intersecting with the axis of the opening of the toner feeding section. During the process of mounting the developer on the toner feeding section, if a lateral side of the sponge is contacted with the toner feeding section, then a shear force acts on the sponge and consequentially damages the sponge. It is greatly likely that the toner leaks from the position where the sponge is damaged. If the sponge is thinned, then the shear force acting on the sponge can be reduced. However, if the sponge is thin, it is likely that the toner leaks from between the toner feeding section and the developer.

DETAILED DESCRIPTION

In accordance with an embodiment, an image forming apparatus comprises a first component, a second component, a first end surface, a second end surface and a sealer. A first opening is formed on the first component.

A second opening is formed on the second component, and the second component can be mounted on or dismounted from the first component by being moved towards a direction intersecting with the axis of the first opening. When mounted on the first component, the second component feeds a toner to the first component or receives a toner from the first component via the first and the second opening. The first end surface is formed on the edge of the first opening of the first component in such a manner that the first end surface is inclined with respect to the axis of the first opening and opposite to the second component. The second end surface is formed on the edge of the second opening of the second component opposite to the first component. The sealer is arranged on the first or second end surface. When the second component is mounted on the first component, the sealer seals the part between the first end surface and the second end surface while keeping the first opening communicated with the second opening.

The image forming apparatus disclosed herein is described below with reference to accompanying drawings.

Figure 1:
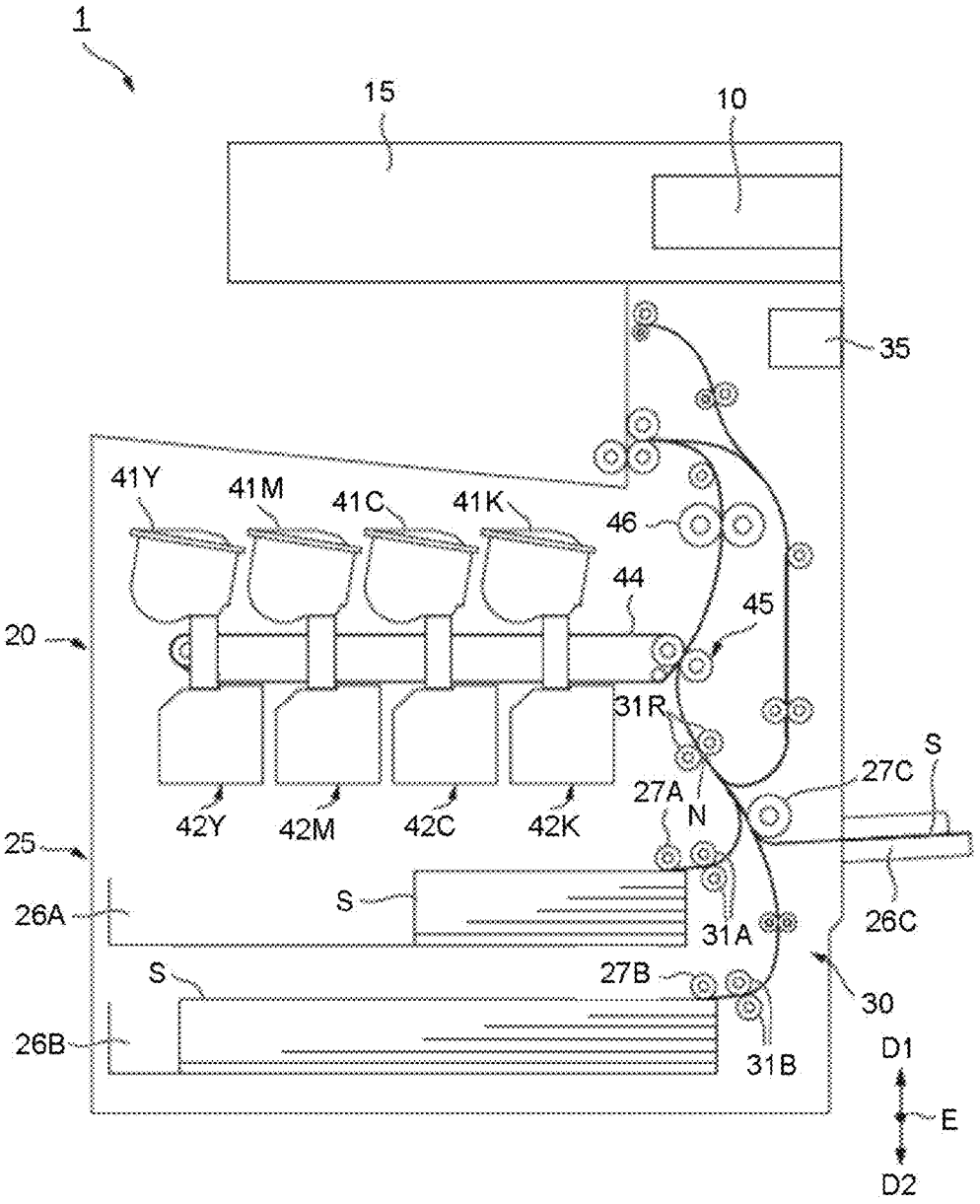
FIG. 1 is a schematic diagram illustrating a section of an example of a whole image forming apparatus according to an embodiment.

As shown in FIG. 1, an image forming apparatus 1 comprises a control panel 10, a scanner unit 15, a printer unit 20, a sheet accommodation unit 25, a conveyance unit 30 and a control unit 35.

The control unit 35 is operated when an input operation is conducted on the control panel 10.

The scanner unit 15 reads the image information of the copied object as light intensity and outputs the read image information to the printer unit 20.

The printer unit 20 forms an output image (hereinafter referred to as a toner image) using a developing agent containing a toner according to the image information received from the scanner unit 15 or the outside. The printer unit 20 transfers the toner image onto the surface of a sheet S. The printer unit 20 applies heat and pressure to the toner image on the surface of the sheet S to fix the toner image on the sheet S.

The sheet accommodation unit 25 feeds sheets, one by one, for the printer unit 20 matching in time with the formation of toner images by the printer unit 20. The sheet accommodation unit 25 is provided with a plurality of paper cassettes 26A and 26B and a manual section 26C. Sheets S of predetermined sizes and predetermined types are placed in the paper cassettes 26A and 26B and the manual section 26C. The manual section 26C is capable of feeding a sheet Shaving a thickness unacceptable for the paper cassettes 26A and 26B for the printer unit 20. The cassettes 26A and 26B and the manual section 26C are equipped with pickup rollers 27A, 27B and 27C, respectively. The pickup rollers 27A, 27B and 27C all pick up sheets, one by one, from the paper cassettes 26A and 26B and the manual section 26C. The pickup rollers 27A, 27B and 27C feed the sheet picked up to the conveyance unit 30.

The conveyance unit 30 comprises conveyance rollers 31A and 31B and a register roller 31R. The conveyance rollers 31A and 31B convey the sheet fed from the paper cassettes 26A and 26B to the register roller 31R.

The register roller 31R conveys the sheet according to the timing at which the printer unit 20 transfers a toner image onto the surface of the sheet S. The conveyance rollers 31A and 31B prop the front end of the sheet S in the conveyance direction of the sheet S against the nip N of the register roller 31R. The conveyance rollers 31A and 31B neaten the position of the front end of the sheet S in the conveyance direction of the sheet S by curving the sheet S. The register roller 31R neatens the front end of the sheet S conveyed from the conveyance rollers 31A and 31B at the nip N. Further, the register roller 31R conveys the sheet S to a transfer section 45 which is described later.

Figure 2:
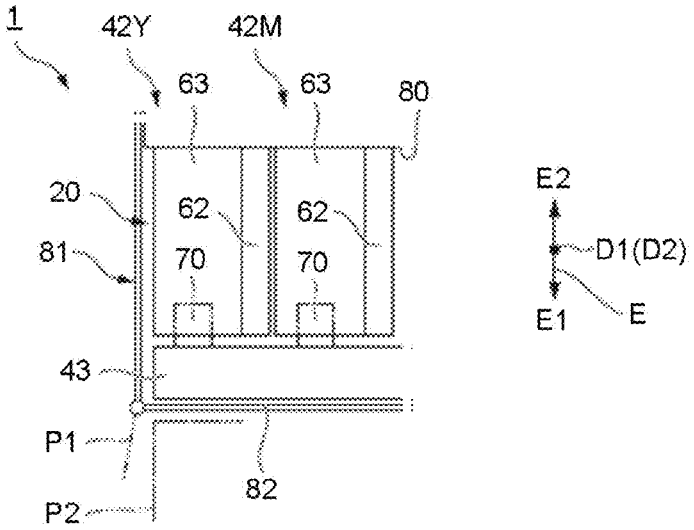
FIG. 2 is schematic diagram illustrating a section of the main parts of an image forming apparatus according to an embodiment.

As shown in FIG. 1 and FIG. 2, the printer unit 20 comprises toner feeding sections (first components) 41Y, 41M, 41C and 41K (hereinafter referred to as a toner feeding section 41Y) and image forming sections 42Y, 42M, 42C and 42K (hereinafter referred to as an image forming section 42Y). The printer unit 20 further comprises a waste toner cartridge (refer to FIG. 2), an intermediate transfer belt 44, a transfer section 45 and a fixer 46.

Figure 3:
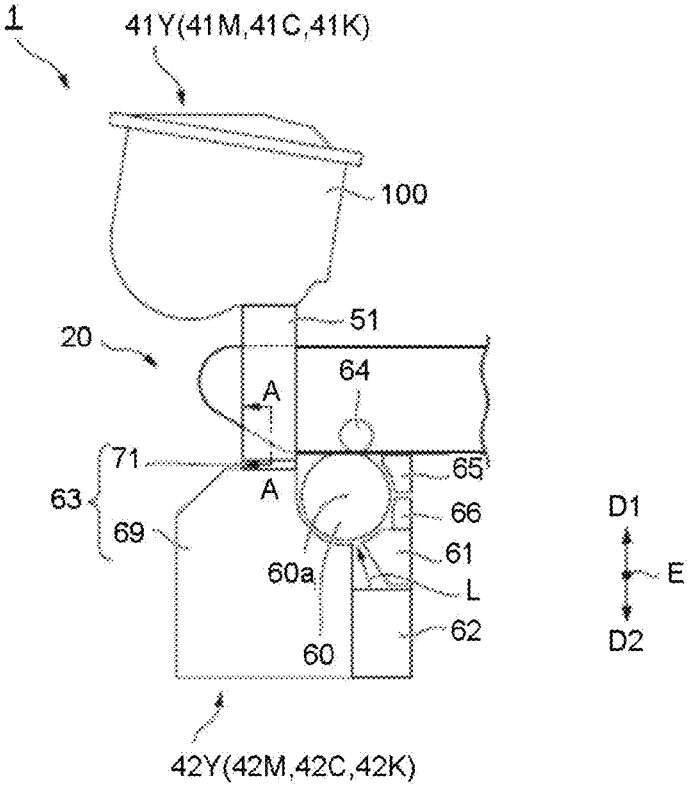
FIG. 3 is an enlarged view of the main parts shown in FIG. 1.
Figure 4:
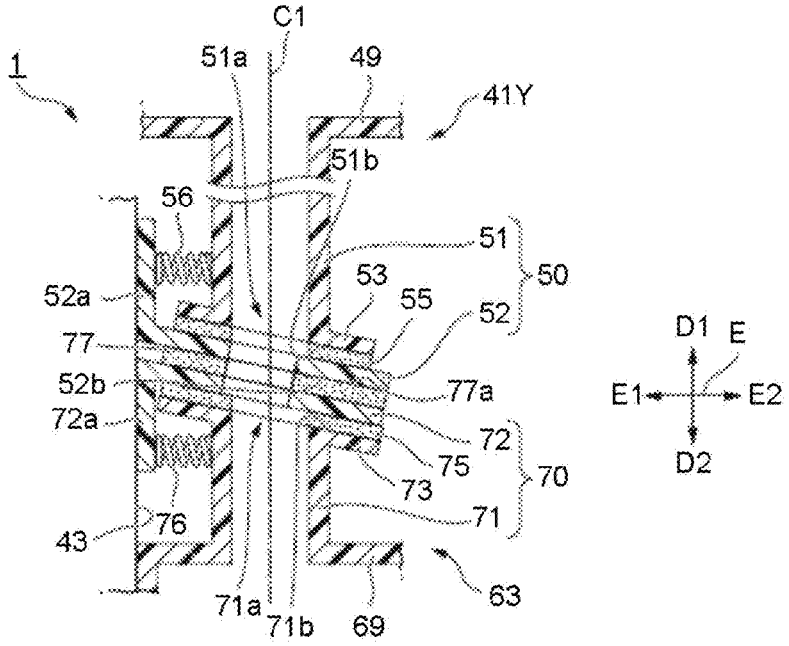
FIG. 4 is a schematic diagram illustrating a section taken along the line A-A shown in FIG. 3 in which a developer is mounted on a toner feeding section and two shutters are pressed down.

As shown in FIG. 3 and FIG. 4, the toner feeding section 41Y comprises a container mounting component 49 which can be mounted on or dismounted from an ink cartridge container 100 and a first feed pipe 50 (first pipe) arranged on the container mounting component 49. FIG. 4 shows a state in which the developer 63 which is described later is mounted on the first feed pipe 50 of the toner feeding section 41Y. The developer 63 is mounted opposite to the toner feeding section 41Y. The side of the toner feeding section 41Y with respect to the developer 63 is hereinafter referred to as an upstream side D1, and the side of the developer 63 with respect to the toner feeding section 41Y is hereinafter referred to as a downstream side D2. In the embodiment, the toner feeding section 41Y and the developer 63 are arranged with the upstream side D1 and the downstream side D2 substantially parallel to the vertical direction.

The ink cartridge containers 100 which can be mounted on or dismounted from the container mounting components 49 such as the toner feeding section 41Y separately accommodate a yellow toner, a magenta toner, a cyan toner and a black toner. The toners accommodated in the ink cartridge containers 100 are transferred to the first feed pipe 50 through the container mounting component 49 by a toner transferring section (not shown).

The first feed pipe 50 comprises a first feed pipe body (a first pipe body) 51 and a first shutter (a first cover component) 52. The first feed pipe body 51 is formed in a pipe shape. Further, the 'pipe shape' here includes a shape the section of which orthogonal to the axis of the first feed pipe body 51 is circular or polygonal such as hexagonal, but not limited to a shape the section of which orthogonal to the axis of the first feed pipe body is rectangular. For the pipe shape, no specific limitation is given to the ratio of the length of the pipe in the axial direction to the outer diameter of the pipe in the direction orthogonal to the axis. The ratio may be very large or very small.

The opening formed on the end of the first feed pipe body 51 at the downstream side D2 is a first opening 51*a*.

A first flange 53 protruding towards the radial outer side of the first feed pipe body 51 is formed on the end of the first feed pipe body 51 at the downstream side D2. The end surface formed on the first feed pipe body 51 and on the edge of the first opening 51*a* in the first flange 53 is a first end surface 51*b*. The first end surface 51*b* is inclined with respect to the axis C1 of the first opening 51*a*. That is, the first end surface 51*b* is not orthogonal to the axis C1. The first end surface 51*b* facing the front side E1 is inclined towards the upstream side D1. The first end surface 51*b* is arranged opposite to the developer 63.

A sponge 55 for sealing the part between the first feed pipe body 51 and the first shutter 52 is arranged on the first end surface 51*b*. A through hole (unsigned) communicating with the first opening 51*a* of the first feed pipe body 51 is formed on the sponge 55. For example, the sponge 55 is preferably a high airtightness rubber sponge which has independent bubbles. The sponge 55 is adhered on the first end surface 51*b* using an adhesive. As the first feed pipe body 51 is provided with the first flange 53, the area of the first end surface 51*b* is increased. Because of the arrangement of the first flange 53, the area of the sponge 55 is increased. The container mounting component 49, the first feed pipe body 51 and the first flange 53 are integrally formed using a resin such as ABS (Acrylonitrile-Butadiene-Styrene).

The first shutter 52 is formed in a plate shape. A through hole (unsigned) is formed in the center of the first shutter 52. A holding plate 52*a* extending towards the upstream side D1 is arranged on the end of the first shutter 52 on the front side E1. The first shutter 52 and the holding plate 52*a* may be made from the same material with the container mounting component 49.

Claws or reinforcing ribs (not shown) are formed on the first feed pipe body 51 and the first flange 53. By means of the claws or reinforcing ribs, the first shutter 52 can be moved, with respect to the first feed pipe body 51, towards the front side E1 and the rear side E2 along the first end surface 51*b*. The direction in which the front side E1 and the rear side E2 are included is hereinafter referred to as an anterior-posterior direction E.

The anterior-posterior direction E is a direction orthogonal to the axis C1. The anterior-posterior direction E is intersected with, but not orthogonal to, the first end surface 51, that is, the outer side 52*b* of the first shutter 52 at the downstream side D2.

Figure 5:
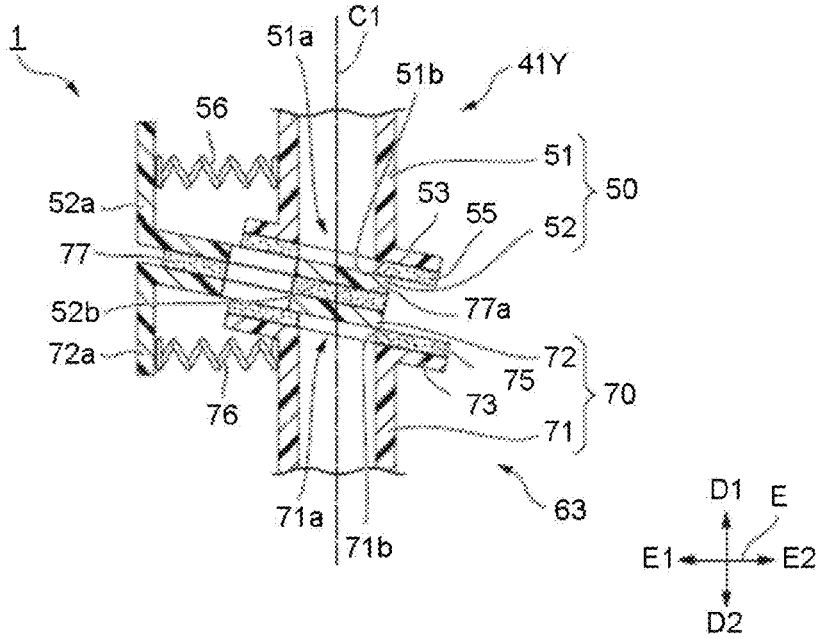
FIG. 5 is a schematic diagram illustrating a state of an image forming apparatus in which a developer is mounted on a toner feeding section and two shutters are pulled back according to an embodiment.

The first feed pipe 50 is provided with a first spring (first force applying component) 56 between the first feed pipe body 51 and the holding plate 52*a*. The first spring 56 may be a spiral spring or a torsion spring. When the first shutter 52 is in a natural state (in a pulled back state) in which no external force is applied to the first shutter 52, the first spring 56 applies a force to the first shutter 52 in such a manner that the first shutter 52 covers the pipeline of the first feed pipe body 51, as shown in FIG. 5. When in the natural state, the first shutter 52 is moved to the front side E1 with respect to the first feed pipe body 51. The pipeline of the first feed pipe body 51 is covered and closed by the first shutter 52 (hereinafter referred to as the closed state of the first shutter 52). When in the closed state, the first shutter 52 prevents the leakage of a toner from the first feed pipe body 51. That is, under the force applied by the first spring 56, the first shutter 52 enters a closed state automatically To resist the force applied by the first spring 56, the first shutter 52 is moved toward the rear side E2 with respect to the first feed pipe body 51, as shown in FIG. 4. If the first shutter 52 is moved towards the rear side E2, the pipeline of the first feed pipe body 51 is opened as no longer covered by the first shutter 52 (hereinafter referred to as the opened state of the first shutter 52). The first shutter 52 covers the pipeline of the first feed pipe body 51 in an openable/closable manner.

The toner feeding sections 41Y, 41M, 41C and 41K feed a yellow toner, a magenta toner, a cyan toner and a black toner to developers 63 of the image forming sections 42Y, 42M, 42C and 42K.

Each image forming section 42Y forms the toner image transferred on a sheet S on the intermediate transfer belt 44.

The intermediate transfer belt 44 consists of the endless belt shown in FIG. 1. The intermediate transfer belt 44 is endowed with a tension by a plurality of rollers propped against the internal circumferential surface of the intermediate transfer belt 44. The intermediate transfer belt 44 is erected flatly.

The image forming section 42Y is equipped with the cylindrical photoconductive drum 60 shown in FIG. 3. The image forming section 42Y and the like forms yellow, magenta, cyan and black toner images on the photoconductive drums 60, respectively.

Each photoconductive drum 60 rotates by taking its rotation shaft 60*a* as its center. The rotation shaft 60*a* is connected with a drum motor (not shown). The rotation shaft 60*a* rotates along the clockwise direction (not shown) under the effect of the drum motor. The photoconductive drum 60 is arranged below the intermediate transfer belt 44.

The image forming section 42Y is provided with a charger 61, an exposure portion 62, a developer (the second component) 63, a transfer roller 64, a cleaning unit 65 and a charge remover 66 which are arranged along a clockwise direction around the photoconductive drum 60.

For example, the charger 61 comprises a discharging wire (not shown) and a charged electrode consisting of a needle electrode. The charger 61 charges the photoconductive drum 60.

The exposure portion 62 irradiates the surface of the charged photoconductive drum 60 with the light L of a Light Emitting Diode (LED) the illumination of which is controlled according to image information. The image information of yellow, magenta, cyan and black are provided to the exposure portions 62 of the image forming sections 42Y. The exposure portion 62 irradiates the charged photoconductive drum 60 with LED light L (or laser light) based on the image information. The exposure portion 62 forms electrostatic latent images on the surfaces of the photoconductive drums 60 based on image information of yellow, magenta, cyan and black.

The developer 63 of the image forming portion 42Y (42M, 42C, 42K) accommodates a developing agent containing a yellow (magenta, cyan and black) toner. The developing agent is the mixture of a carrier composed of magnetic substance particles and a yellow (magenta, cyan and black) toner.

As shown in FIG. 4, the developer 63 comprises a developing material accommodation section 69 and a second feed pipe (a second pipe) 70 arranged in the developing material accommodation section 69. The second feed pipe 70 includes a second feed pipe body (a second pipe body) 71 formed in a pipe shape and a second shutter (a second cover component) 72. The opening formed on the end of the second feed pipe body 71 at the upstream side D1 is a second opening 71*a*.

A second flange 73 protruding towards the radial outer side of the second feed pipe body 71 is arranged on the end of the second feed pipe body 71 at the upstream side D1. The end surface formed on the second feed pipe body 71 and the edge of the second opening 71*a* in the second flange 73 is a second end surface 71*b*. The second end surface 71*b* is arranged opposite to the first end surface 51*b* of the toner feeding section 41Y. The second end surface 71*b* is substantially parallel to (or parallel to) the first end surface 51*b*.

A sponge 75 for sealing the part between the second feed pipe body 71 and the second shutter 72 is arranged on the second end surface 71*b*. A through hole (unsigned) communicating with the second opening 71*a* of the second feed pipe body 71 is formed on the sponge 75. As the second feed pipe body 71 is provided with the second flange 73, the area of the second end surface 71*b* is increased. Because of the arrangement of the second flange 73, the area of the sponge 75 is increased.

The second shutter 72 is formed in a plate shape. A through hole (unsigned) is formed in the center of the second shutter 72. A holding plate 72*a* extending towards the downstream side D2 is arranged on the end of the second shutter 72 on the front side E1. The developing material accommodation section 69, the second feed pipe body 71 and the second flange 73 are integrally formed using the same resin with the container mounting component 49. The second shutter 72 and the holding plate 72*a* are both integrally made from the same resin with the container mounting component 49.

Claws or reinforcing ribs (not shown) are formed on the second feed pipe body 71 and the second flange 73. By means of the claws or reinforcing ribs, the second shutter 72 can be moved, with respect to the second feed pipe body 71, towards the front side E1 and the rear side E2 along the second end surface 71*b*.

The second feed pipe 70 is provided with a second spring (a second force applying component) 76 between the second feed pipe body 71 and the holding plate 72*a*. When the second shutter 72 is in a natural state in which no external force is applied to the second shutter 72, as shown in FIG. 5, the second spring 76 applies a force to the second shutter 72 in such a manner that the second shutter 72 covers the pipeline of the second feed pipe body 71. When in the natural state, the second shutter 72 is moved to the front side E1 with respect to the second feed pipe body 71. The pipeline of the second feed pipe body 71 is covered and closed by the second shutter 72 (hereinafter referred to as the closed state of the second shutter 72). When in the closed state, the second shutter 72 prevents the leakage of the toner from the second feed pipe body 71. That is, under the force applied by the second spring 76, the second shutter 72 enters the closed state automatically.

To resist the force applied by the second spring 76, the second shutter 76 is moved toward the rear side E2 with respect to the second feed pipe body 71, as shown in FIG. 4. If the second shutter 72 is moved towards the rear side E2, the pipeline of the second feed pipe body 71 is opened as no longer covered by the second shutter 72 (hereinafter referred to as the opened state of the second shutter 72), the second shutter 72 covers the pipeline of the second feed pipe body 71 in an openable/closable manner.

A sponge (sealer) 77 is arranged on the outer side of the opposite side of the sponge 75 in the second shutter 72. In other words, the sponge 77 is arranged on the second end surface 71*b* of the second feed pipe 70. A through hole (unsigned) communicating with that of the second shutter 72 is arranged on the sponge 77. The sponges 75 and 77 are made from the same material with the sponge 55. The outer side 77*a* of the sponge 77 at the upstream side D1 is substantially parallel to (or parallel to) the first end surface 51*b*, that is, the first shutter 52. Further, the outer side of the sponge 77 refers here to the outer peripheral surface. The sponge 77 is adhered on the first end surface 51*b* using an adhesive.

The developer 63 is mounted on the toner feeding section 41Y, and the thickness of the sponge 77 is reduced when the shutters 52 and 72 are pressed. The sponge 77 seals the part between the first end surface 51*b* and the second end surface 71*b* while keeping the first opening 51*a* and the second opening 71*a* communicated with each other.

The developers 63 of the image forming sections 42Y, 42M, 42C and 42C charge the toners fed from the toner feeding sections 41Y, 41M, 41C and 41K and accommodated in the developers 63. The developers 63 feed the charged toners to the surfaces of opposite photoconductive drums 60. The toner is adhered to the surface of the photoconductive drum 60 according to an electrostatic latent image. The developer 63 develops the electrostatic latent image formed by the exposure section 62. The developer 63 carries out a development operation based on the development of a two-component developing system.

The developer 63 with this structure is mounted on the toner feeding section 41Y during the running process of the image forming apparatus 1. In this case, the rear side E2 of the developer 63 is supported by a supporting component 80, as shown in FIG. 2. As shown in FIG. 4, the second shutter 72 of the developer 63 is opened by being pressed by a waste toner cartridge 43 from the front side E1. The first shutter 52 of the toner feeding section 41Y is opened by being pressed by the waste toner cartridge 43 from the front side E1.

As shown in FIG. 2, a cover 82 is rotationally supported by a casing 81 in the image forming apparatus 1. The waste toner cartridge 43 is supported by the cover 82 in such a manner that the waste toner cartridge 43 is prevented from moving towards the front side E1.

To be rotationally opened, the cover 82 is moved towards the position P1 shown in FIG. 2. The waste toner cartridge 43 is taken out from the image forming apparatus 1. As shown in FIG. 5, under the force of the springs 56 and 76, the shutters 52 and 72 are pulled back to the front side E1 to be closed.

Figure 6:
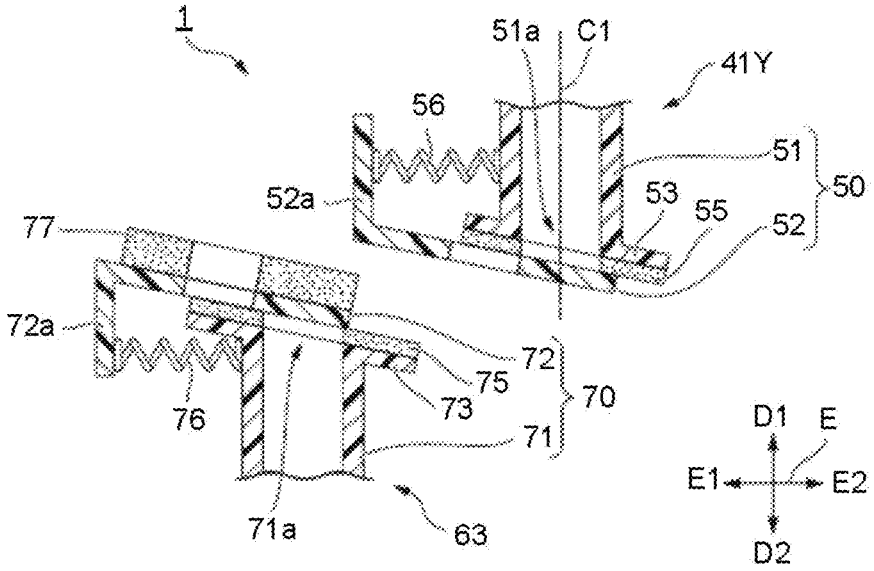
FIG. 6 is a schematic diagram illustrating a state of an image forming apparatus in which a developer is separated from a toner feeding section according to an embodiment.

As shown in FIG. 2, the developer 63 is moved to the position P2 at the front side E1 along the exposure section 62 with respect to the toner feeding section 41Y. Then, as shown in FIG. 6, the second feed pipe 70 of the developer 63 is separated from the first feed pipe 50 of the toner feeding section 41Y.

On the other hand, the developer 63 is moved towards the rear side E2 with respect to the toner feeding section 41Y to be contacted with the supporting component 80 and then mounted on the toner feeding section 41Y with the axis of the second opening 71*a* aligned with the axis C1 of the first opening 51*a*. In this way, the developer 63 can be mounted on or dismounted from the toner feeding section 41Y by being moved along the anterior-posterior direction E with respect to the toner feeding section 41Y.

As shown in FIG. 3, the transfer roller 64 is configured opposite to the photoconductive drum 60 across the intermediate transfer belt 44 propped against the surface of the photoconductive drum 60. The transfer roller 64 transfers the toner image on the surface of the photoconductive drum 60 onto the intermediate transfer belt (primary transfer).

Each image forming section 42Y (42M, 42C, 42K) applies a transfer bias to the transfer roller 64 at a primary transfer position.

The cleaning unit 65 erases the toner left on the surface of the photoconductive drum 60 after the primary transfer.

The charge remover 66 irradiates the surface of the photoconductive drum 60 passing the cleaning unit 60 to remove the charges of the photoconductive drum 60.

In the intermediate transfer belt 44, the transfer section 45 shown in FIG. 1 is arranged adjacent to the image forming portion 42K.

The transfer section 45 transfers the charged toner image on the intermediate transfer belt 44 onto the surface of the sheet S at a secondary transfer position. The transfer section 45 sets the secondary transfer position to be opposite to a support roller and a secondary transfer roller.

The transfer section 45 applies a transfer bias controlled by transfer current to the secondary transfer position. The transfer section 45 transfers the toner image on the intermediate transfer belt 44 onto the sheet S via the transfer bias.

The fixer 46 fixes the toner image on the surface of the sheet S on the sheet S through the heat and the pressure applied to the sheet S.

The control unit 35 controls the image forming apparatus 1 according to an instruction from, for example, the control panel 10.

Next, the actions of the image forming apparatus 1 with the foregoing structure in operation are described below.

If the control panel 10 is operated or an external signal is input, the image forming apparatus 1 starts an image formation process. Image information is acquired by reading the copied object using the scanner unit 15 and output to the printer unit 20, or image information is output to the printer unit 20 from the outside.

The conveyance unit 30 feeds a sheet S from the sheet accommodation unit 25 to the register roller 31R.

The image forming section 42Y carries out a charging operation, an exposure operation, a development operation and a transfer operation according to image information corresponding to difference colors. For example, the yellow toner accommodated in the ink cartridge container 100 of the toner feeding section 41Y is transferred to the first feed pipe 50 by the toner transfer section. The developer 63 receives the toner from the toner feeding section 41Y via the first opening 51*a* and the second opening 71*a*.

The image forming section 42Y forms the toner mage transferred on the sheet S on the intermediate transfer belt 44 on which toner images are successively overlapped. The toner image is transferred to the transfer section 45 and secondarily transferred on the sheet S which is fed to the transfer section 45 by the register roller 31R. The secondarily transferred toner image is fixed on the sheet S by the fixer 46.

Sequentially, the maintenance on the developer 63 of the image forming apparatus 1 is described below. The user of the image forming apparatus 1 separates the developer 63 from the toner feeding section 41Y. Specifically, the user rotates the cover 82 with respect to the casing 81 to dismount the waste toner cartridge 43 from the image forming apparatus 1. As shown in FIG. 5, the first shutter 52 is automatically closed under a force applied by the first spring 56. Similarly, the second shutter 72 is automatically closed under a force applied by the second spring 76.

The pipeline of the first feed pipe body 51 is covered by the first shutter 52, thereby preventing the toner from leaking from the pipeline of the first feed pipe body 51. Similarly, the pipeline of the second feed pipe body 71 is covered by the second shutter 72, thereby preventing the toner from leaking from the pipeline of the second feed pipe body 71.

As shown in FIG. 6, by moving the developer 63 towards the front side E1 with respect to the toner feeding section 41Y, the user separates the developer 63 from the toner feeding section 41Y. After the developer 63 is separated, the sponge 77 regains its thickness in a natural uncompressed state.

Figure 7:
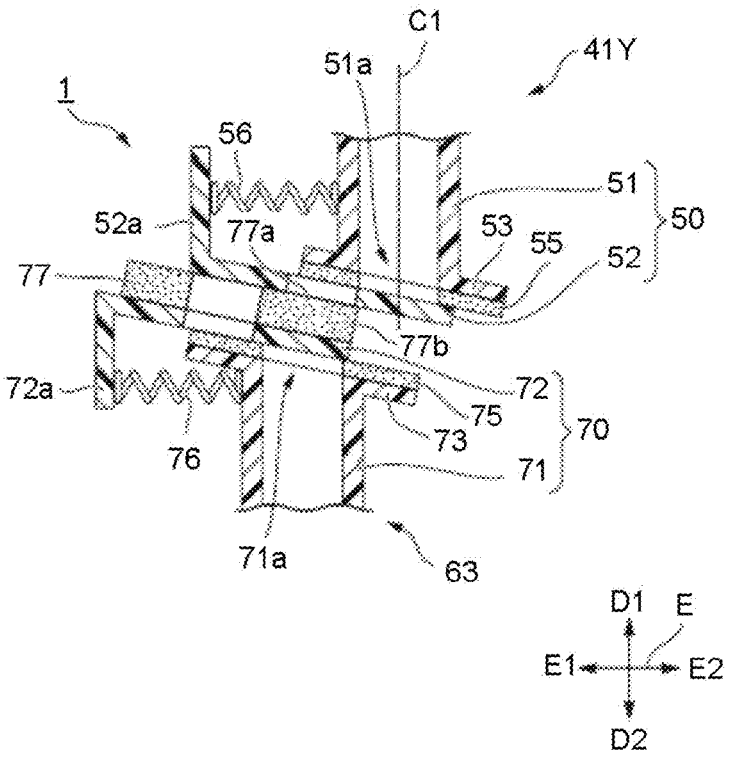
FIG. 7 is a schematic diagram illustrating a section of an image forming apparatus in which the sponge of a developer separated from a toner feeding section is contacted with a first shutter according to an embodiment.

After completing the maintenance on the developer 63, the user mounts the developer 63 on the toner feeding section 41Y again. Specifically, as shown in FIG. 7, the user moves the developer 63 towards the rear side E2 with respect to the toner feeding section 41Y. The outer side 77*a* of the sponge 77 is contacted with the first shutter 52 while the lateral side 77*b* of the sponge 77 at the rear side E2 is not contacted with the first shutter 52, thus preventing a shear force from acting on the sponge 77.

The outer side 77*a* of the sponge 77 is substantially parallel to the first shutter 52, thus, the outer side 77*a* of the sponge 77 is substantially uniformly compressed. As the second end surface 71*b* is substantially parallel to the first end surface 51*b*, the sponge 77 is compressed more uniformly.

When the developer 63 moved by the user towards the rear side E2 is contacted with the supporting component 80, the axis of the second opening 71*a* is aligned with the axis C1 of the first opening 51*a*, as shown in FIG. 5. Then, the developer 63 is mounted on the toner feeding section 41Y. In this case, the thickness of the sponge 77 is reduced when compared with that of the sponge 77 in a natural state.

The shutters 52 and 72 are pressed towards the rear side E2 to mount the waste toner cartridge 43 on the image forming apparatus 1. The shutters 52 and 72 are switched to the opened state from the close state. Yellow toner is fed to the developer 60 from the toner feeding section 41Y through the first opening 51*a* and the second opening 71*a*. The user closes the cover 82.

The user carries out the same operation to maintain the developers 63 of the image forming portions 42M, 42C and 42K.

As stated above, according to the image forming apparatus 1 described herein, the anterior-posterior direction E in which the developer 63 is moved with respect to the toner feeding section 41Y intersects with the first end surface 51*b*, that is, the outer side 52*b* of the first shutter 52. When the user mounts the developer 63 on the toner feeding section 41Y, the lateral side 77*b* of the sponge 77 is prevented from being contacted with the first shutter 52, thus preventing a shear force from acting on the sponge 77. As a result, the sponge 77 is protected against being damaged. Thus, a thicker sponge 77 can be used to prevent the leakage of a toner effectively, resulting in that it is difficult for the toner to leak from between the toner feeding section 41Y and the developer 63.

If the second feed pipe body 71 is provided with the second flange 73, then the area of the second end surface 71*b* is increased. The area of the sponge 75 arranged on the second end surface 71*b* is consequentially increased. Thus, the sponge 75 can seal the part between the second feed pipe body 71 and the second shutter 72 more practically.

As the outer side 77*a* of the sponge 77 is substantially parallel to the first shutter 52, the sponge 77 can be substantially uniformly compressed from the outer side 77*a* when the user presses the second shutter 72 towards the rear side E2.

The second feed pipe 70 of the developer 63 comprises the second feed pipe body 71 and the second shutter 72. The second shutter 72 opens the pipeline of the second feed pipe body 71 when the image forming apparatus 1 is in operation and closes the pipeline of the second feed pipe body 71 during a maintenance process. The second shutter 72 closes the pipeline of the second feed pipe body 71 so as to prevent a toner from leaking from the pipeline of the second feed pipe body 71 during a maintenance process.

The second feed pipe body 71 is provide with the second spring 76 which enables the second shutter 72 to enter a closed state automatically. The second shutter 72 enters a closed state automatically to prevent the toner from leaking from the pipeline of the second feed pipe body 71 more practically.

As the second end surface 71*b* is substantially parallel to the first end surface 51*b*, the sponge 77 is compressed more uniformly.

As the first feed pipe body 51 is provided with the first flange 53, the area of the first end surface 51*b* is increased. The area of the sponge 55 arranged on the first end surface 51*b* is increased, thus, the sponge 55 can seal the part between the first feed pipe body 51 and the first shutter 52 more practically.

The first feed pipe 50 of the toner feeding section 41Y comprises the first feed pipe body 51 and the first shutter 52. The first shutter 52 opens the pipeline of the first feed pipe body 51 when the image forming apparatus is in operation and closes the pipeline of the first feed pipe body 51 during a maintenance process. The first shutter 52 closes the pipeline of the first feed pipe body 51 so as to prevent the toner from leaking from the pipeline of the first feed pipe body 51 during a maintenance process.

The first feed pipe 50 is provide with a first spring 56 which enables the first shutter 52 to enter a closed state automatically to prevent the toner from leaking from the pipeline of the first feed pipe body 51 more practically.

Further, in embodiments described herein, the developer 63 has a sponge 77 on the second end surface 71*b*. However, the toner feeding section 41Y may also be arranged on the first end surface 51*b*, that is, the sponge 77 is arranged on the outer side of the opposite side of the sponge 55 in the first shutter 52.

The first end surface 51*b* of the toner feeding section 41Y for feeding a toner to the developer 63 may also be orthogonal to the axis C1. Further, the second end surface 71*b* of the developer 63 may be inclined with respect to the axis C1. This structure can also achieve the effect achieved in embodiments described herein.

Figure 8:
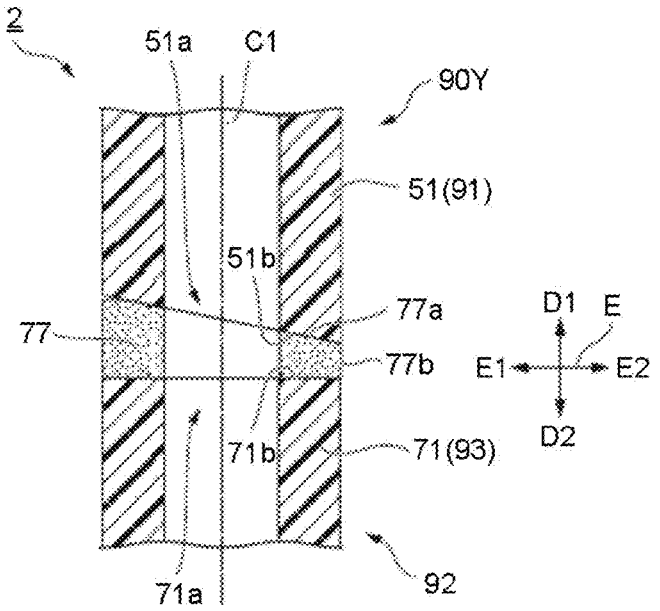
FIG. 8 is a schematic diagram illustrating a section of a variation of an embodiment of an image forming apparatus in which a developer is mounted on a toner feeding section.

The toner feeding section 90Y shown in FIG. 8 consists of a first feed pipe 91 and the second feed pipe 93 of a developer 92. Compared with the structure of the first feed pipe 50, the first feed pipe 91 is not provided with the first shutter 52, the first flange 53, the sponge 55 and the first spring 56. Compared with the structure of the second feed pipe 70, the second feed pipe 93 is not provided with the second shutter 72, the second flange 73, the sponge 75 and the second spring 76. The second end surface 71*b* is orthogonal with the axis C1 of the first opening 51*a*. The sponge 77 is arranged on the second end surface 71*b*.

An image forming apparatus 2 consists of the toner feeding section 90Y and the developer 92.

Figure 9:
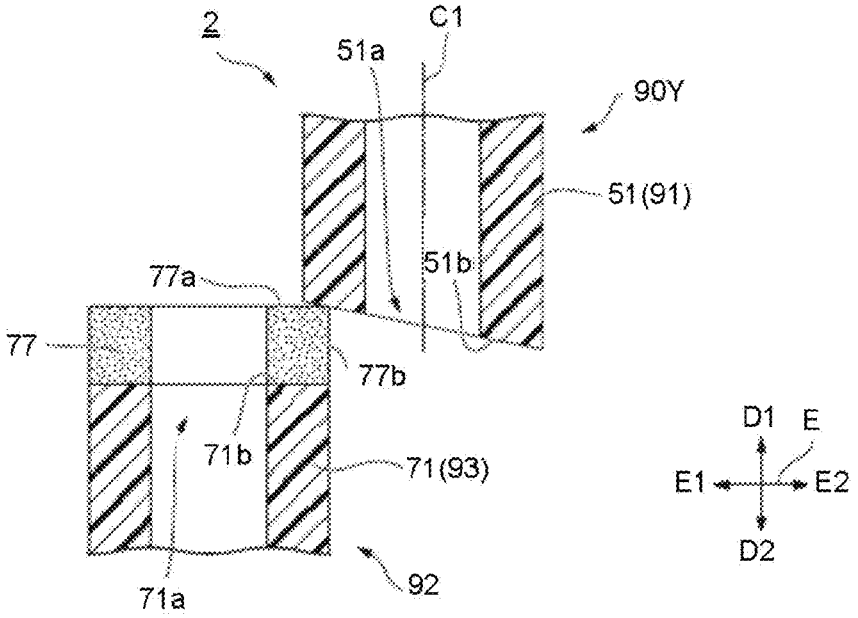
FIG. 9 is a schematic diagram illustrating a section of a variation of an embodiment of an image forming apparatus in which a developer is separated from a toner feeding section.

In the image forming apparatus 2 with this structure, to mount the developer 92 which is separated from the toner feeding section 90Y, as shown in FIG. 9, the user moves the developer 92 towards the rear side E2 with respect to the toner feeding section 90Y, as shown in FIG. 8. The outer side 77*a* of the sponge 77 is contacted with the first end surface 51*b* of the first feed pipe body 51. The lateral side 77*b* of the sponge 77 is prevented from being contacted with the first end surface 51*b* of the first feed pipe body Si, thus preventing a shear force from acting on the sponge 77.

When the first shutter 52 is pressed by the waste toner cartridge 43 and opened, the first shutter 52 is kept open by a claw of the first feed pipe 50. In this case, if the clamping of the first shutter 52 with the claw is released, then the first shutter 52 is closed under a force applied by the first spring 56. The second shutter 72 is operated in the same way.

The container mounting component 49 of the toner feeding section 41Y is not provided with the first feed pipe 50, and a first opening is directly formed on the container mounting component 49. The developing agent accommodation section 69 of the developer 63 is not provided with the second feed pipe 70, and a second opening is directly formed on the developing agent accommodation section 69.

In the foregoing examples, it is assumed that the first component is the toner feeding section 41Y and the second component is the developer 63, however, the two components are not limited to this. For example, one of the first component and the second component may be the ink cartridge container 100, and the other one is the container amounting component 49.

According to at least one of the foregoing embodiments, the lateral side 77*b* of the sponge 77 is prevented from being contacted with the first shutter 52 during the process of mounting the developer 63 on the toner feeding section 41Y, thus preventing a shear force from acting on the sponge 77.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a first component provided with a first opening;

a second component provided with a second opening, the second component being mountable on or dismountable from the first component by being moved towards a direction intersecting with an axis of the first opening;

a first end surface formed on the edge of the first opening of the first component in such a manner that the first end surface is inclined at an angle between 0 and 90 degrees with respect to the axis of the first opening and opposite to the second component;

a second end surface formed on the edge of the second opening of the second component opposite to the first component; and a sealer arranged on the first or second end surface, the sealer being inclined with respect to the axis of the first opening towards a same direction as the direction in which the first end surface is inclined, and when the second component is mounted on the first component, the sealer seals the part between the first end surface and the second end surface while keeping the first opening communicated with the second opening.

2. The image forming apparatus according to claim 1, wherein the second component is provided with a second pipe on which the second opening and the second end surface are formed; and a second flange protruding towards the radial outer side of the second pipe is arranged on the end of the second pipe opposite to the first component.

3. The image forming apparatus according to claim 1, wherein the sealer is arranged on the second end surface of the second component; and the outer side of the sealer opposite to the first component is substantially parallel to the first end surface.

4. The image forming apparatus according to claim 1, wherein the second component is provided with a second pipe on which the second opening and the second end surface are formed; and the second pipe comprises:

a second pipe body; and a second cover component which is movably arranged in a direction intersecting with the axis with respect to the second pipe body and which covers a pipeline of the second pipe body in an openable/closable manner.

5. The image forming apparatus according to claim 4, comprising:

a second force applying component configured to apply a force to enable the second cover component to cover the pipeline of the second pipe body.

6. The image forming apparatus according to claim 1, wherein the second end surface is substantially parallel to the first end surface.

7. The image forming apparatus according to claim 1, wherein the first component is provided with a first pipe on which the first opening and the first end surface are formed; and a first flange protruding towards the radial outer side of the first pipe is arranged on the end of the first pipe opposite to the second component.

8. The image forming apparatus according to claim 1, wherein the first component is provided with a first pipe on which the first opening and the first end surface are formed; and the first pipe comprises:

a first pipe body; and a first cover component which is movably arranged in a direction intersecting with the axis with respect to the first pipe body and which covers a pipeline of the first pipe body in an openable/closable manner.

9. The image forming apparatus according to claim 8, comprising:

a first force applying component configured to apply a force to enable the first cover component to cover the pipeline of the first pipe body.

10. The image forming apparatus according to claim 1, wherein the first component is a toner feeding section for feeding the toner to the second component; and the second component is a developer for charging the toner fed from the toner feeding section.

11. A developer provided with a second opening, the developer being mountable on or dismountable from a first component by being moved towards a direction intersecting with the axis of a first opening of the first component, and the developer having a second end surface formed on the edge of the second opening opposite to the first component, the developer comprising:

a sealer arranged on the second end surface, the sealer being inclined at an angle between 0 and 90 degrees with respect to the axis of the first opening towards the same direction as the direction in which a first end surface is inclined, the first end surface being formed on the edge of the first opening of the first component in such a manner that the first end surface is inclined with respect to the axis of the first opening and opposite to the developer, and when the developer is mounted on the first component, the sealer seals the part between the first end surface and the second end surface while keeping the first opening communicated with the second opening.

* * * * *